US005308055A

United States Patent [19]

Binnen

[11] Patent Number: 5,308,055

[45] Date of Patent: May 3, 1994

[54] TRAILING NOZZLE DEVICE FOR FAST PAPER FEEDERS

[75] Inventor: Georg Binnen, Obersulm, Fed. Rep. of Germany

[73] Assignee: Koenig & Bauer Aktiengesellschaft, Wurzburg, Fed. Rep. of Germany

[21] Appl. No.: 924,045

[22] PCT Filed: Feb. 27, 1991

[86] PCT No.: PCT/DE91/00160

§ 371 Date: Sep. 2, 1992

§ 102(e) Date: Sep. 2, 1992

[87] PCT Pub. No.: WO91/13822

PCT Pub. Date: Sep. 19, 1991

[30] Foreign Application Priority Data

Mar. 3, 1990 [DE] Fed. Rep. of Germany ..... 4006635

[51] Int. Cl.[5] ..... B65H 5/08

[52] U.S. Cl. ..... 271/15; 271/11; 271/105; 271/107; 271/226

[58] Field of Search ..... 271/11, 90, 105, 107, 271/250, 267, 14, 15, 226; 403/225; 267/141, 153, 279

[56] References Cited

U.S. PATENT DOCUMENTS

| | | | |
|---|---|---|---|
| 2,238,435 | 4/1941 | Perry | 403/225 |
| 2,251,416 | 8/1941 | Parker | 403/225 X |
| 2,722,416 | 11/1955 | Backhouse . | |
| 2,772,104 | 11/1956 | Thiry | 403/225 |
| 3,893,775 | 7/1975 | Sievers et al. . | |
| 4,671,678 | 6/1987 | Münch | 403/225 X |
| 4,786,043 | 11/1988 | Jiruse et al. | 271/105 X |

FOREIGN PATENT DOCUMENTS 2163083 12/1971 Fed. Rep. of Germany .

OTHER PUBLICATIONS

*Machine Design*, vol. 44, No. 29; Nov. 30, 1972; pp. 56–61; "Rubber Bearings"; Eugene Sprow. Russian text; p. 523; published 1988.

*Primary Examiner*—D. Glenn Dayoan
*Assistant Examiner*—Boris Milef
*Attorney, Agent, or Firm*—Jones, Tullar & Cooper

[57] ABSTRACT

A tractor nozzle device for fast running sheet feeders is distinguished in that rubber-metal bushings (66, 72) are provided for the bearings between the support bridge and the rocker as bearings for the mutual absorption of the back-and-forth movements (44) as well as the additional deflection movements (106).

8 Claims, 1 Drawing Sheet

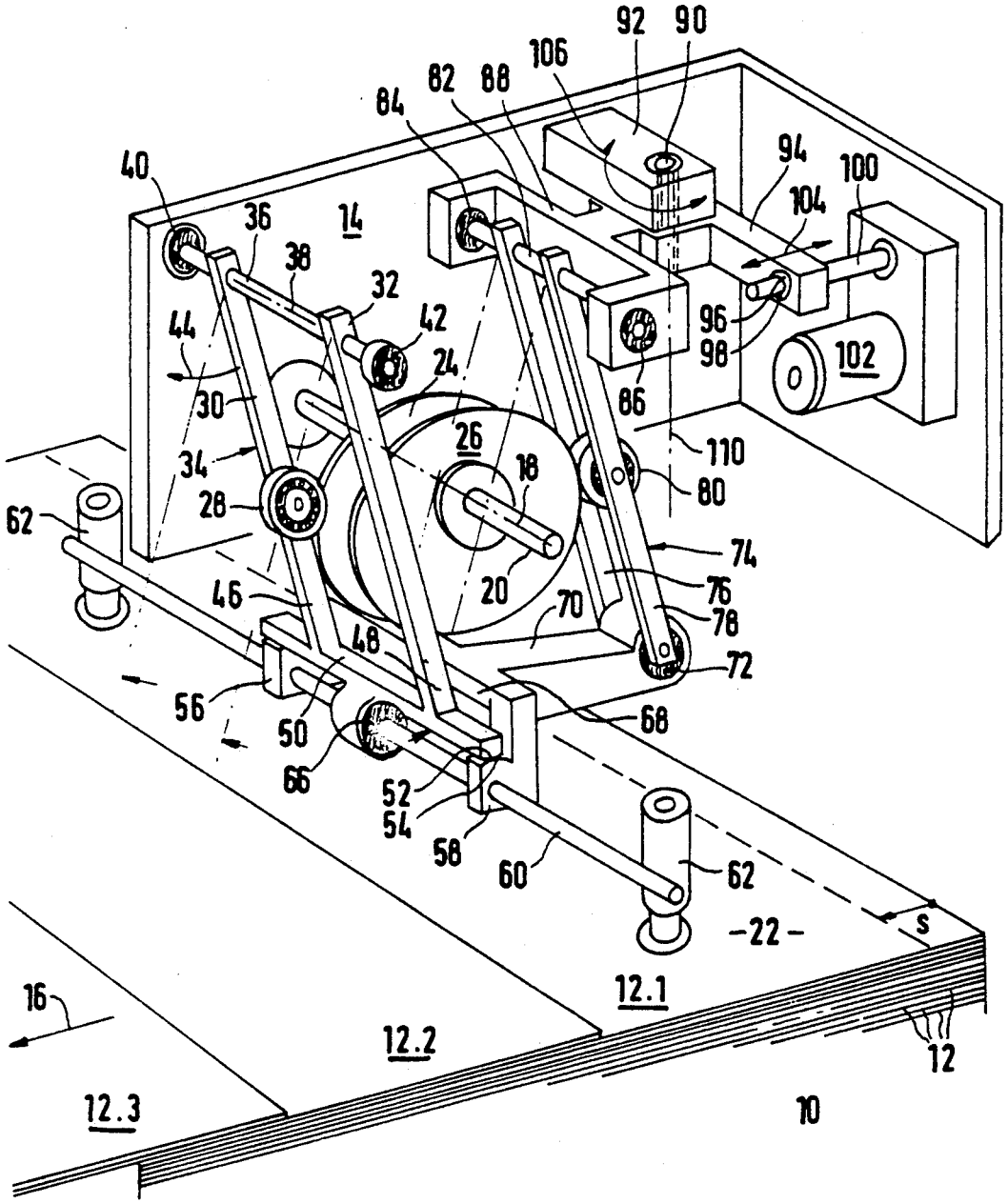
92
90
106
82
88
84
94
100
104
40
36
14
38
32
42
44
24
96
98
102
30
86
26
110
34
18
80
28
62
74
46
20
76
70
78
48
72
56
68
50
66
52
54
58
60
62
-22-
s
16
12.1
12.2
12
12.3
10

TRAILING NOZZLE DEVICE FOR FAST PAPER FEEDERS

FIELD OF THE INVENTION

The invention relates to a tractor nozzle device for fast running sheet feeders. The sequential feeding of individual sheets of a sheet stack to a printing press, such as an offset printing press, is performed so that the sheets are brought into a scale-like arrangement. This scale-like alignment of the sheets lifted off a sheet stack and appropriately pushed forward is performed with so-called suction heads.

To form this scale-like arrangement in the running direction of the sheet feeder, the tractor nozzles are required to make a back-and-forth or oscillating movement. In addition, the tractor nozzles must be able to perform a deflection movement, because the stacks or the individual sheets of such stacks are not exactly aligned in the feed direction of a printing press. It is therefore necessary that the suction heads also have a so-called correction feature for slanted sheets.

DESCRIPTION OF THE PRIOR ART

A known tractor nozzle device of the type mentioned above has a rocker which can perform an oscillating back-and-forth movement. This oscillating movement is generated by means of a cam roller fixed on the rocker and connected fixed against tension and pressure to a cam plate. At the lower stop of the rocker, an approximately horizontally oriented support bridge is provided which, together with the rocker, performs the approximately horizontally oscillating movement. At the back this support bridge is seated supported by means of rollers in such a way that during its back-and-forth movement it is also seated supported at its back end. These rollers can additionally be deflected sideways, so that the support bridge can also perform a laterally deflected movement. In case of a not quite exact positioning of the sheets, this lateral deflection movement provides the required correction of slanted sheets. The front end of this support bridge is rotatably connected with the rocker via a first bearing in order to make the back-and-forth movement of the support bridge together with the rocker possible in this way. The front end of the support bridge is additionally fastened on the rocker via a second bearing, which allows the required lateral deflection movement of the support bridge.

So-called sliding or rolling bearings are used for embodying these bearings. Because of the quite high clock rate of sheet feeders, which may be around 12,000 back-and-forth movements per hour in known sheet feeders, the direction of rotation of these rolling bearings must be reversed correspondingly often. These very fast changes in the direction of rotation cause high acceleration forces on the rotating parts in the bearing and worsen the lubricant supply to the inside of the bearing, so that these bearings tend to pit. Because of the design of the bearing between the rocker and the support bridge in the form of two independent bearings, this junction has a relatively large inherent weight, so that correspondingly high oscillations and great wear is to be expected. Thus clock rates above 15,000 back-and-forth movements per hour are not possible. Because of component-related tolerances between the bearing and the rocker or support bridge, after a while the pressure forces of the rollers against the roll-off faces of the slant adjustment are no longer sufficient on account of the slippage caused by the reversal of the direction of running or rotation, which additionally results in rapid wear.

SUMMARY OF THE INVENTION

Based on this state of the art, it is the object of the invention to provide a tractor nozzle device for fast running sheet feeders which does not have the disadvantages known from the prior art and which therefore makes long service life and as high a possible clock rates possible.

The previously mentioned tractor nozzle device known from the prior art is therefore distinguished in that rubber-metal elements, in particular rubber-metal bushings are provided as bearings for the mutual absorption of the back-and-forth movements as well as the additional deflection movements. Such bushings are bearing elements consisting of an inner and outer sleeve fixedly connected with each other by means of a resiliently deformable mass. Bushings of this type as structural elements are known. Bushings of this type damp oscillations which act radially and axially on them. They can be stressed for torsion and can absorb cardanic deflections. Thus, the invention is based on the realization that it is possible to construct sheet feeders which use such bushings, wherein the oscillations increasingly appearing at high clock rates are minimized and which permit an oscillating motion free of wear and maintenance without any lubrication. The correction of slanted sheets is also possible without additional elements by means of these bushings.

It was possible to attain clock rates of more than 18,000 back-and-forth movements per hour in fast running sheet feeders equipped with such a traction nozzle device.

It was shown to be advantageous, for minimizing the basic interfering oscillations and to make a wear- and maintenance-free oscillating movement possible, to embody those bearings which need only be designed for absorbing back-and-forth movements also as rubber-metal bushings.

With the use of such rubber-metal bushings, a design of a tractor nozzle device of the previously mentioned type was shown to be simple where two rockers are provided, where on the one hand the front rocker is seated with its upper end oscillating around a first shaft and on the other hand is connected by its lower end area with the front end area of the support bridge via at least one rubber-metal bushing. The lower end area of the rear one of these two rockers is connected with the back end area of the support bridge via a rubber-metal bushing and is seated in its upper end area oscillating around a second shaft. Furthermore, this upper end area can perform, together with the second shaft, a rotary movement around a third axis which is oriented crosswise to the second shaft. In this connection it was proven to be useful if rubber-metal bushings were also provided as bearings for the first shaft.

In accordance with a further characteristic of the invention it was proven to be useful for the upper bearing of the second rocker, if its second shaft is seated in a yoke which is fastened to be pivotable around a bearing, which bearing is oriented perpendicularly for the back-and-forth movement of the two rockers.

So that resilient pressure elements, by means of which the cam roller fastened on the rocker is pressed against the complimentary cams which control the back-and-forth movement can be omitted, a structure of the previously mentioned tractor nozzle device was proven to be useful wherein each one of the two rockers is provided with a cam roller and the cam plate embodied as a double cam plate is present between these two cam rollers. One of these double cam plates rests against one of the two cam rollers. Because of the rubber-metal bushes provided, a resiliently yielding seating of the cam rollers outside of the two cam plates is assured, without tolerance deviations of the two complementary cams which occur of necessity having disadvantageous effects and thus requiring additional structural steps. In this way the two rockers always firmly rest against the double cam plates via the cam rollers.

In accordance with a further characteristic of the invention, a lever is fastened on the yoke of the rear rocker, and can be adjusted by means of its free end crosswise to its longitudinal extent either manually or by a motor drive. The yoke can be pivoted by moving this lever and in this way the desired or required slanted sheet correction of the tractor nozzle device can be achieved. Although this back-and-forth movement of the lever takes place on an arc of a circle, the center of which circle is located in the bearing shaft, on account of the relatively small pivot movement of the lever it is possible to adjust the latter in such a way, that its free end is displaced along a threaded rod with which its end is in meshing engagement. In this case the threaded rod is displaced either manually or by a motor-operated linear drive. This threaded rod is disposed to be freely projecting, so that its projecting arm can perform a slightly oscillating movement. In this way practically no crowding forces can occur between the threaded rod and the lever.

In accordance with a further characteristic of the invention, the bearing between the support bridge and the rear rocker is positioned in its extreme rear position exactly in the extension of the pivot shaft for the yoke on which the rear rocker is pivotably seated. In this way it is achieved that a slantingly positioned sheet is picked up in the non-pivoted state of the support bridge and therefore of the cross bar by means of suction nozzles and is aligned by pivoting during the tractor movement.

It is assured by the fixedly aligned rotary shaft of the front rocker that the cross bar, which is aligned parallel to the oscillating axis of this rocker, always is exactly aligned with this oscillating axis in the extreme forward oscillating position of both rockers. Therefore, when depositing a sheet, this oscillating axis of the front rocker is aligned parallel to the desired orientation of the oscillating rod. To fulfill this requirement by simple means, in accordance with a further characteristic the front end area of the support bridge is embodied in the shape of a fork with two head pieces. The cross bar with its tractor suction pieces is fastened on each of these two head pieces. Furthermore, the rubber-metal bushing of the front rocker and the cross bar is located in this area. The lower end areas of the front rocker furthermore terminate in a cross piece connected in its center area with this metal-rubber bushing and is seated with its two end areas on the two head pieces. The mutual bearing surfaces of the cross piece and the two head pieces each have rounded sections in such a way that the two adjacent surfaces can roll along on each other during the back-and-forth movement of the rocker. In this way the cross bar is always parallel above the sheet stack in every position of the rocker.

Further characteristics and advantages of the invention ensue from the additional characteristics recited in the claims and from the exemplary embodiment below.

BRIEF DESCRIPTION OF THE DRAWINGS

The invention will be described and explained in detail below by means of the exemplary embodiment illustrated in the drawings. The single drawing figure shows a schematic perspective illustration of a tractor nozzle device for a fast running sheet feeder in a partial view.

DESCRIPTION OF THE PREFERRED EMBODIMENT

The frame 14 of a tractor nozzle device is mounted above the rear area of a stack 10 of sheets 12 placed on top of each other. The tractor nozzle device is a part of a fast running sheet feeder, not illustrated in detail. Sheets 12 are fanned open sequentially in a scale-like manner, such as illustrated in the drawing by sheets 12.1, 12.2, 12.3. These sheets are then fed in the transport direction 16 to an offset printing press, not shown in detail.

A shaft 18 extends from the frame 14 and its rotating shaft axis 20 is disposed parallel above the plane 22 of the stack 10. Two cam plates 24, 26 are disposed at a distance from each other secure against relative rotation on this shaft 18. A cam roller 28 rests secure against relative rotation against the rear cam plate 24 in the drawing, and in turn is placed, secure against relative rotation, on the rear member 30 of a rocker 34 consisting of two members 30, 32. The two members 30, 32, and thus the rocker 34, are rotatably seated with their upper ends on a shaft 36. The axis 38 of this shaft 36 extends perpendicularly to the long extension of the two rod-shaped members 30, 32. The shaft 36 is firmly seated on the frame 14 in a left and right bearing bushing 40, 42. The rocker can therefore perform an oscillating back-and-forth movement around the axis 38 (curved arrow 44).

The lower end areas 46, 48 of the two rod-shaped members 30, 32 are rigidly connected with each other via a cross piece 50, which is oriented parallel to the axis 38. Each one of the end areas of the cross piece 50 have a lower rounding 52, with which they rests against corresponding roundings 54 of head pieces 56, 58 shown left and right in the drawing. The roundings 52, 54 are of such a type that during the back-and-forth oscillation of the rocker 34 the rounding 52 remains on and rolls along the rounding 54.

A cross bar 60, on which traction aspirators 62 are fixed, extends through the two head pieces 56, 58. These traction aspirators 62 are used to lift, i.e. grip by suction, sheets 12. In the illustration, the traction aspirators 62 are just present above the stack 10 for gripping the sheet 12.1 by suction.

The cross piece 50 is fastened in the area between the two head pieces 56, 58 on a bearing bushing 66 which is provided on the cross bar 60.

The two head pieces 56, 58 are connected with each other via a yoke 68. This yoke 68 is the front end of a support bridge 70, as seen in the drawing. This support bridge 70 is disposed at right angles to the cross bar 60 with its traction aspirators 62 by means of the head pieces 56, 58.

The rear end of this support bridge 70 has a bearing bushing 72 in which a rear rocker 74 is seated. This rear rocker 74 has, the same as the front rocker 34, two rod-shaped members 76, 78 disposed parallel to each other, which are fastened on the two ends of the bushing. A cam roller 80 is rotatably fastened on the member 78, to the right in the drawing. This cam roller 80 rests, fixed against relative rotation, against the front cam plate 26. In this way the cam rollers 28, 80 rest, fixed against relative rotation, from both sides against the two cam plates 24 or 26.

The upper ends of the two rod-shaped members 76, 78 are rotatably seated on a shaft 82.

With parallel orientation of the shaft 82 with the shaft 36 of the front rocker 34, the two rockers 34, 74 perform an oscillating-like movement located in the same plane. In the course of this oscillating movement the support bridge 70 describes an elongated curved line, also in this plane.

The shaft 82 of the rear rocker 74 is rotatably seated with its ends in two bearing bushings 84, 86. The two bearing bushings 84, 86 are a part of a yoke 88. This yoke 88 is pivotably seated in a plane parallel to the plane 22 in a bearing 90, the axis 110 of which is oriented perpendicularly to the plane 22 of the stack 10. This bearing 90 is fixed in place on the frame 14 by means of a bar 92. The yoke 88 extends, with the portion of its area towards the back in the drawing, beyond the bearing 90. This rear portion is connected to as an angled lever arm 94. A bore 96 is disposed on the free end of this angled lever 94. A threaded rod 100 is seated rotatably, but not movable in its longitudinal direction, in a bearing 98 in this bore 96. The threaded rod 100 is rotatable by a linear drive 102 fixed on the frame 14. In the course of this rotational movement of the threaded rod 100, the angled lever 94 is displaced to the left or the right along the arrow 104 in the drawing. Because of the projecting construction of this threaded rod 100 and its relatively easily bending embodiment, and also because of the actually very small movements in the direction of the arrow 104, no crowding forces occur in the bearing 90 in the course of the linear displacement of the lever arm 94 along the threaded rod 100. In this way the angled lever 94 can be displaced in the direction along the curved arrow 106. Therefore the yoke 88 can also be pivoted in the direction along the curved arrow 106. This displacement of the yoke 88 results in a displacement of the bearing bushing 72 and thus in a lateral displacement of the support bridge 70. In the same way as the bushing 66, the bushing 72 is embodied as a so-called rubber-metal bushing. These bushings consist of an inner and outer sleeve between which a resiliently deformable mass is disposed which is fixedly connected with the two sleeves. Such a bearing can be loaded in the radial and axial directions as well as torsionally and therefore can also absorb cardanic deflections.

In the course of pivoting of the yoke 88, the support bridge 70 can also pivot in a plane parallel to the plane 22. Because the bushing 72 is located exactly underneath the bearing 90, this bushing 72 will only be displaced around the perpendicular axis 110 of the bearing 90 during pivoting of the yoke 88 around the bearing 90; no lateral displacement of the bushing 72 will take place.

Because the two bearing bushings 66, 72 are in the form of rubber-metal bushings, the two cam rollers 28, 80 rest free of play and fixed against relative rotation against the respective cam plate 24 or 26. Pressure mechanisms of any type are not required for these cam rollers.

The tractor nozzle device shown operates in the following manner.

In the position shown in the drawing, the support bridge 70 is in its maximally rearmost position. It remains in this position for a while to give lifting nozzles, not shown, a chance to lift the topmost sheet 12.1. Following this lifting, the traction aspirators 26 then take over the lifted sheet to move it in the transport direction 16 by the distance s. In its position displaced by the distance s, the sheet 12.1 also has the same distance and the same orientation in respect to the sheet 12.2, which this sheet 12.2 has in respect to the sheet 12.3.

To bridge this distance s, the front and rear rockers 34, 74 perform an appropriate oscillating movement along the curved arrow 44. In the course of this oscillating movement the support bridge 70 traverses a correspondingly arc-shaped curved path. Because of the relatively small oscillation amplitude, the curved path is in actuality sufficiently straight, so that the different height in the vertical direction of the cross bar 60 in respect to the sheet 12.1 can be neglected.

In the extreme left position of the support bridge 70, not shown, in which the two rockers 34, 74 are correspondingly far swung out, the traction aspirators 62 are deactivated and the sheet 12.1 is let go.

If the stack 10 does not have exactly the same orientation as, for example, the sheet 12.3 and instead is oriented at a somewhat oblique angle to it—something which is also correspondingly true for each one of its sheets—the slanted orientation must be corrected during the transport of the sheet along the distance s. In the position shown in the drawing figure, the cross bar 60 with the traction aspirators 62 is pivoted in a plane parallel to the plane 22 by pivoting of the yoke 88 around the bearing 90 in such a way, that the cross bar 60 is again parallel to the respective sheet to be picked up, which is not exactly aligned; the rear rocker 74 with the support bridge 70 has been laterally pivoted.

After picking up this not exactly aligned sheet—for example sheet 12.1—the two rockers 34, 74 now swing in a clockwise direction around the respective shafts 36, 82. During this oscillating movement, the rear rocker 74 is laterally displaced in a clockwise direction because of the fixed orientation of the front shaft 36 and thus also the front rocker 34 in such a way, that in its extreme left position in which the sheet 12.1 is to be transferred, it lies pivoted with respect to the front rocker 34 and because of this the sheet 12.1 comes to rest parallel with the sheet 12.2.

When swinging back into its position shown in the drawing, because of the corresponding displacement of the yoke 88 the rocker 74 then is again aligned in the same way as the sheet to be picked up has been found to be positioned in space.

Because of the embodiment of the two bushings 66, 72 as rubber-metal bushings, the seating of the entire rocker assembly free of play is possible, which makes possible an extremely high clock rate of back-and-forth movements per hour.

The bearing bushings 40, 42, 84, 86 are also embodied as rubber-metal bushings. By means of this, seating free of play, wear and maintenance is also achieved for these bearings with simple constructive means.

Since in the exemplary case illustrated these six rubber-metal bushings 66, 72, 40, 42, 84, 86 are installed in the perpendicular position of the two rockers 34, 74, these bushings act to brake the rockers during rapid oscillating movements of the rockers, because of which the latter are forced to perform smooth oscillations.

Installation of the rubber-metal bushings does not require exact coaxial bores and axle journals, which considerably simplifies the production of the parts to be installed.

Because of their relatively small inherent weight, the rubber-metal bushings used transfer the necessary torsion and cardanic deflections in a manner free of play, maintenance and wear. Furthermore, because of the cardanic tiltability of the two rubber-metal bushings 66, 72, the required slanted position of the support bridge 70 is generated without additional rollers and roll-off planes.

I claim:

1. A tractor nozzle device for a fast running sheet feeder, said tractor nozzle device comprising:

a front rocker supported at an upper end by a first support shaft for oscillating motion;

a first cam roller carrier by said front rocker a first cam plate supported on a rotatable drive shaft, said first cam plate being in contact with said first cam roller;

a support bridge having a front end which is connected to a lower end of said front rocker;

a support device for a rear end of said support bridge, said support device including a rear rocker supported at an upper end by a second support shaft and having a lower end connected to a rear portion of said support bridge by a rubber-metal bushing and permitting back and forth oscillating movement of said support bridge;

a second cam roller carried by said rear rocker;

a second cam plate supported on said rotatable drive shaft, said second cam plate being in contact with said second cam roller;

spaced traction aspirators seated on a cross bar, said cross bar being pivotably seated in said lower end of said front rocker by a rubber-metal bushing; and means for performing a deflection movement of said cross bar and said traction aspirators by causing said rear portion of said support bridge to move in a direction generally crosswise to said back and forth movement of said support bridge, said rubber-metal bushings facilitating said back and forth movement and said deflection movement of said support bridge and said support device.

2. The tractor nozzle device of claim 1 wherein rubber-metal bushings are provided as bearings for said first shaft.

3. The tractor nozzle device of claim 1 wherein said second shaft is supported by a yoke which is pivotably fastened on a bearing which is oriented perpendicular to said back and forth movement of said support bridge.

4. The tractor nozzle device of claim 3 wherein said bearing for said yoke is securely attached to a frame portion of said tractor nozzle device.

5. The tractor nozzle device of claim 4 wherein a pivot axis for said bearing is vertically aligned with said rubber-metal bushing in said rear portion of said support bridge when said front and rear rockers are in a rearmost position of their oscillating motion.

6. The tractor nozzle device of claim 3 wherein a first end of a lever arm is secured to said yoke and a second end of said lever arm is adjustably supported, said lever arm being secured to said yoke such that adjustment of said lever arm causes pivotable movement of said yoke around said bearing.

7. The tractor nozzle device of claim 6 wherein a threaded rod is secured to said second end of said lever arm and further wherein means are provided to rotate said threaded rod its longitudinal direction to effect said movement of said yoke.

8. The tractor nozzle device of claim 1 wherein said front end of said support bridge terminates in spaced first and second head pieces, said cross bar being supported in said first and second head pieces and further wherein said lower end of said front rocker terminates in a front cross piece having a center area which supports with said cross bar seating rubber-metal bushing said cross bar and having cross piece end areas which are seated on said first and second head pieces, said head pieces and said cross piece end areas being cooperatively rounded and being able to roll with respect to each other during said oscillating movement of said front rocker.

* * * * *